US005553342A

United States Patent [19]

Townsend

[11] Patent Number: 5,553,342

[45] Date of Patent: Sep. 10, 1996

[54] BRIDGE STRUCTURE INCLUDING SHOCK TRANSMISSION UNITS

[75] Inventor: Gerald H. Townsend, London, United Kingdom

[73] Assignee: Colebrand Limited, London, England

[21] Appl. No.: 431,051

[22] Filed: Apr. 28, 1995

[30] Foreign Application Priority Data

Apr. 29, 1994 [GB] United Kingdom ..... 9408635

[51] Int. Cl.[6] ..... E01D 19/00

[52] U.S. Cl. ..... 14/13; 14/73.5

[58] Field of Search ..... 14/13, 73.1, 73.5, 14/74.5, 14

[56] References Cited

U.S. PATENT DOCUMENTS 5,215,382 6/1993 Kemeny ..... 384/36

FOREIGN PATENT DOCUMENTS 1339762 12/1973 United Kingdom .

*Primary Examiner*—Michael Powell Buiz
*Assistant Examiner*—Pamela A. O'Connor
*Attorney, Agent, or Firm*—Larson & Taylor

[57] ABSTRACT

A bridge structure comprises at least two piers, a deck structure between each pair of adjacent piers supported to allow for relative movement longitudinally of the deck between at least one pier and the deck, a connecting bar and a shock transmission unit in series connected between each pair of adjacent piers, the bar being supported for longitudinal movement independently of the deck. This arrangement allows free relative movement due to thermal expansion, and can accommodate flexing of the deck structure due to live loads. The shock transmission unit forms a longitudinal lock along the piers in the event of a sudden shock such as an earthquake, so that all the piers are combined to resist the shock.

3 Claims, 1 Drawing Sheet

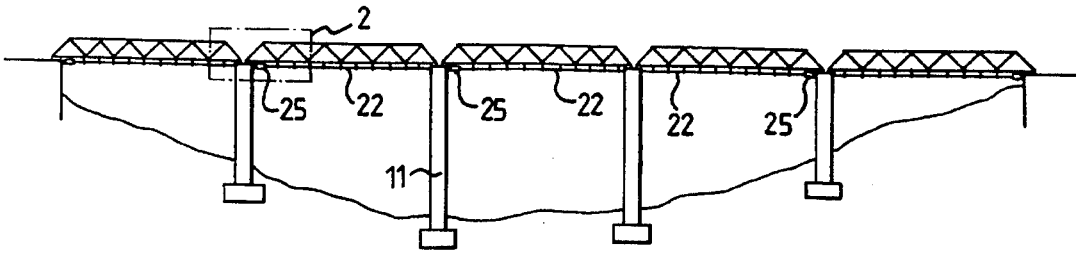
FIG.1
PRIOR ART
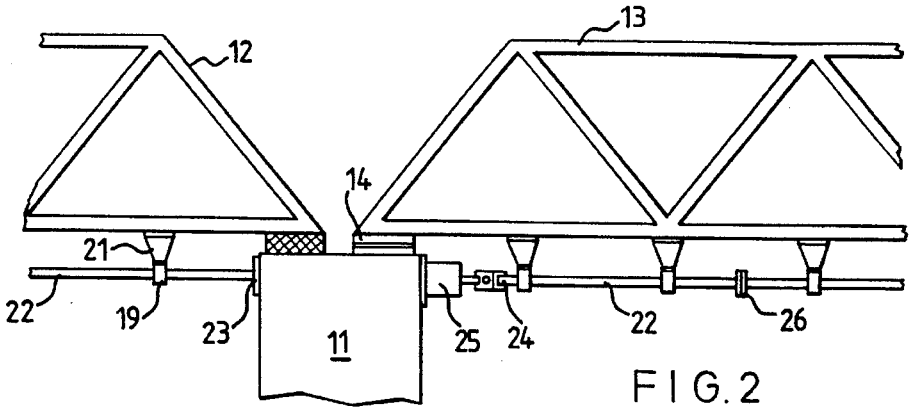
FIG.2
FIG.3
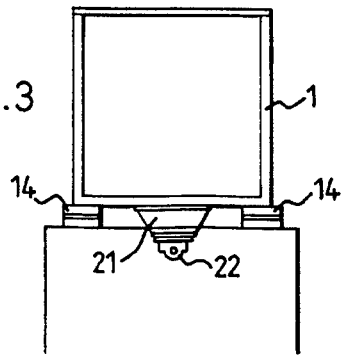

BRIDGE STRUCTURE INCLUDING SHOCK TRANSMISSION UNITS

This invention relates to bridges which have at least two piers and a deck spanning adjacent piers. The connection of the deck to the piers has to take into account a number of different considerations.

Expansion and contraction, particularly of steel bridges, makes it necessary to allow one end of a deck to slide on its bearing while the other end is fixed thus preventing the piers from being connected together by the bridge deck. This movement while very slow can be of quite high magnitude.

As a load passes across the bridge the deck deflects resulting in an increase in length of the bottom chords of the deck structure which has to be accommodated at the free ends. Unlike thermal movement this cycle takes place very rapidly and would activate any shock transmitting device that was connected between the deck and a pier. It has been proposed, for example in GB-A-1339762, to use shock transmitting units in a bridge structure with a shock transmission unit in each expansion joint between adjacent spans of a multi-span structure. Shock transmitting units have the property of transmitting shock loads while providing minimal resistance to loads with a low rate of change. The rapid cycling of the bottom chord of a deck structure would be transmitted by such shock transmission units.

The present invention aims to improve bridge structures by providing a connecting unit comprising a connecting bar and a shock transmission unit in series between adjacent piers, the bar being supported for longitudinal movement independently of the deck. The bar is preferably supported by the deck and is thus constrained against all other movement by the deck. With this arrangement, the piers are unaffected by longitudinal movement of the deck due to thermal expansion and live lead extension but any sudden shocks such as earthquake tremors would be transmitted from pier to pier in the longitudinal direction of the deck by the connecting bars and shock transmission units and so the resistance of the bridge structure to such shocks would be shared between all the piers which would be effectively rigidly connected together as a unitary structure against such shocks. Transverse movement of individual piers would not be affected.

An example of the invention will now be described with reference to the accompanying drawings in which:

FIG. 1 is a diagram of a multi-span rail bridge,

FIG. 2 is a detail of FIG. 1, and

FIG. 3 is a transverse section through the bridge of FIG. 2.

As can be seen in FIG. 2, a pier 11 supports the ends of adjacent deck trusses 12 and 13 at its top end. One deck truss 12 is rigidly fixed to the top of the pier 11 whereas the other truss 13 is mounted on the top of the pier 11 by a bearing 14 which allows longitudinal movement of the truss 13 relative to the pier 11 to accommodate thermal expansion of the truss.

A series of hangers 21 are connected to the bottom of the truss 13 and support a strut 22 in bearings 19 which allow longitudinal movement of the strut but otherwise constrain the strut against movement relative to the deck. The longitudinal spacing of the supports 19 for the strut 22 below the truss 13 is chosen in relation to the flexibility of the strut to prevent it buckling under compressive loads. One end 23 of the strut 22 is connected rigidly to the top of the pier 11 while the other end 24 is connected to the top of the adjacent pier through a shock transmitting unit 25. The strut 22 may be formed from a number of units with flanged ends, the flanges of adjacent units being bolted together to form a flanged coupling 26. As can be seen in FIG. 3, the truss is supported at one end on the top of the pier by bearings 14 at its two sides. At the other end the truss is fixedly supported on the adjacent pier. The strut 22 is mounted below the centre of the truss. The longitudinal spacing of the supports 19 for the strut 22 below the truss 13 is chosen in relation to the flexibility of the strut to prevent it buckling under compressive loads.

The bridge structure so far described differs from conventional bridges using shock transmission units in that the shock transmission unit is not connected by the strut between a pier and a truss, but is connected by the strut between the top regions of adjacent piers. The thermal expansion of the deck structure, which for steel decks is of large amplitude, makes it necessary for relative longitudinal movement between the deck structure and at least one of its supporting piers. It is therefore impossible to connect the piers together by means of the deck structure. Any shock transmission units which might be considered for connection between the deck structure and the pier to allow for the relative movement would have to be specially designed to accommodate the high amplitude of thermal expansion.

Bridges bearing heavy loads, such as railway trains, have to accommodate the deflection of the deck structure by the weight of the train which results in an increase in length of the bottom chords. Those movements take place very rapidly (as the train moves across the bridge) and any shock transmitting unit connected between the deck structure and a pier would not accommodate this increase in length and so the change would be transmitted to the top of the pier which is undesirable.

The strut provided in the bridge illustrated in the drawings cannot be connected directly between piers, because the strut is subject to thermal expansion, as is the deck truss. The strut is therefore connected in series with a shock transmission unit between adjacent piers. The live load problem which affects the deck truss does not affect the strut.

Shocks with high accelerations, for example from earthquakes, applied at the ends of the bridge or at the piers in the direction of the length of the bridge will be transmitted by the struts 22 and the shock transmitting units 25 throughout the length of the bridge so that all the abutments and all the piers are effectively locked together to contribute to the resistance of the bridge to such shocks. Traction and braking forces from trains are similarly shared between all the piers. Since the piers are held together by the struts at the top, it is impossible for them to allow a bridge truss to fall into the gap between them when subject to shocks. On the other hand, the strut 22, lying along the longitudinal horizontal axis below the truss, allows the tops of adjacent piers to move freely transversely relative to one another. Since bridge piers have a very much greater extent transversely of the longitudinal direction of the trusses than their extent in the direction parallel to the longitudinal direction, this free transverse movement of piers should not cause a truss to fall off a pier sideways as the pier moves sideways.

Maximum accelerations experienced in earthquakes lie in the range of 1 to 4 Hz and it is an advantage to construct bridges whose natural frequency is well away from this range. Having the connecting bar and shock transmission unit in series connected between the top region of adjacent piers assists to this end. When the piers are of varying height, the linking of the top regions the natural frequencies of different portions of the bridge will be caused to interfere with each other.

The strut and shock transmitting units can be fitted to existing bridges, or included in the construction of new bridges. Assuming that the deck truss has a horizontal lower boundary, the addition of the strut below it reduces the headroom available by only a small degree and the selected response of the shock transmitting unit to different types of loads avoids interference with the performance of the bridge in normal circumstances, that is, in the absence of shocks with high accelerations.

I claim:

1. A bridge structure comprising at least two piers, a deck structure between each pair of adjacent piers supported to allow for relative movement longitudinally of the deck between at least one pier and the deck, a connecting bar and a shock transmission unit in series connected between each pair of adjacent piers, the bar being supported for longitudinal movement independently of the deck.

2. A bridge structure as claimed in claim 1 wherein the bar between an adjacent pair of piers is supported by the deck structure which is supported between said pair of adjacent piers.

3. A bridge structure as claimed in claim 1 wherein the deck structure is fixedly mounted on one of the pair of adjacent piers on which it is supported.

* * * * *